US005460142A

United States Patent [19]

Denz et al.

[11] Patent Number: 5,460,142

[45] Date of Patent: Oct. 24, 1995

[54] METHOD FOR VENTING A TANK

[75] Inventors: Helmut Denz, Stuttgart; Andreas Blumenstock, Ludwigsburg, both of Germany

[73] Assignee: Robert Bosch GmbH, Stuttgart, Germany

[21] Appl. No.: 258,070

[22] Filed: Jun. 10, 1994

[30] Foreign Application Priority Data

Jun. 30, 1993 [DE] Germany ..... 43 21 694.3

[51] Int. Cl.[6] ..... F02M 25/08

[52] U.S. Cl. ..... 123/520; 123/118 D

[58] Field of Search ..... 123/518, 519, 123/520, 198 D

[56] References Cited

U.S. PATENT DOCUMENTS

| | | | |
|---|---|---|---|
| 4,318,383 | 3/1982 | Iritani et al. | 123/520 |
| 4,926,825 | 5/1990 | Ohtaka et al. | 123/520 |
| 4,949,695 | 8/1990 | Uranishi et al. | 123/520 |
| 5,193,512 | 3/1993 | Steinbrenner et al. | 123/520 |
| 5,195,498 | 3/1993 | Siebler | 123/520 |
| 5,197,442 | 3/1993 | Blumenstock et al. | 123/520 |
| 5,205,263 | 4/1993 | Blumenstock et al. | 123/520 |
| 5,220,896 | 6/1993 | Blumenstock et al. | 123/520 |
| 5,273,020 | 12/1993 | Hayami | 123/520 |
| 5,333,589 | 8/1994 | Otsuka | 123/520 |
| 5,339,788 | 8/1994 | Blumenstock et al. | 123/520 |
| 5,347,971 | 9/1994 | Kobayashi et al. | 123/520 |
| 5,363,828 | 11/1994 | Yamashita et al. | 123/520 |

*Primary Examiner*—Thomas N. Moulis
*Attorney, Agent, or Firm*—Walter Ottesen

[57] ABSTRACT

The invention relates to a method for venting a fuel tank for motor vehicles equipped with internal combustion engines. The tank-venting systems of these motor vehicles are equipped with a sensor for measuring tank pressure. The signal of the pressure sensor is utilized to control the tank-venting valve in such a manner that the flow resistance of the tank-venting valve is so adjusted via its opening condition in dependence upon the signal of the pressure sensor so that the scavenging rate is limited; that is, the flow volume through the tank-venting valve is limited. The scavenging rate is so limited that the tank pressure does not drop below a pregiven threshold. The tank-venting valve acts as a controllable flow throttle for preventing critical underpressures.

12 Claims, 6 Drawing Sheets

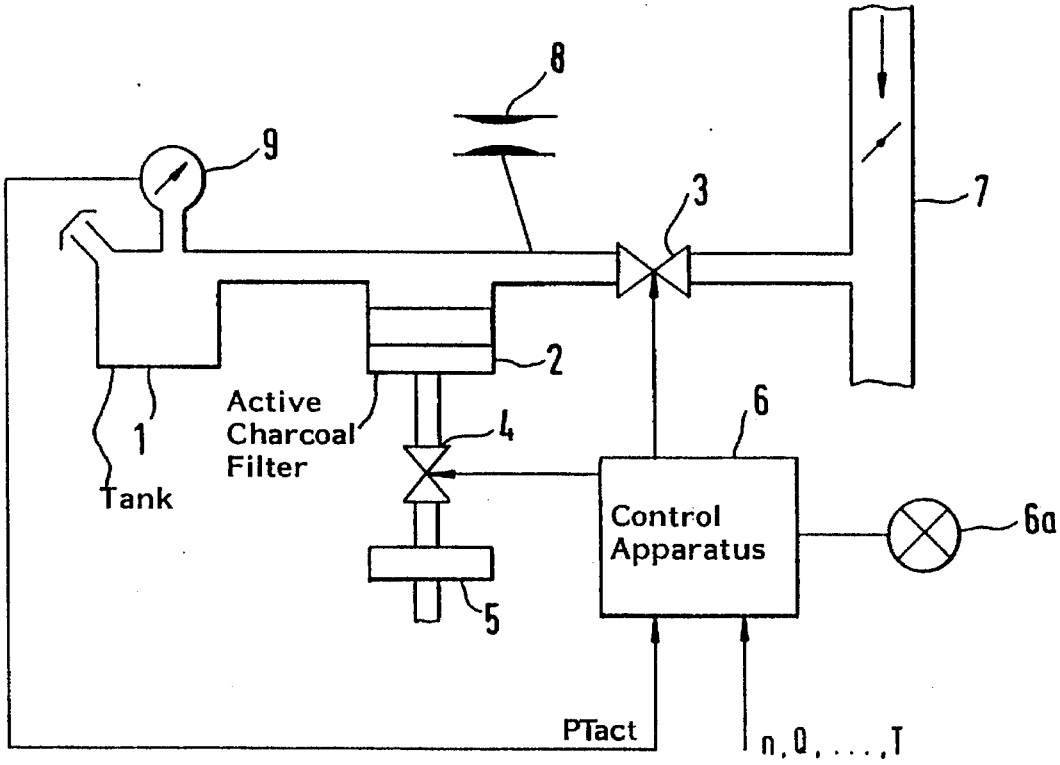
SdT Fig.1
Fig.2
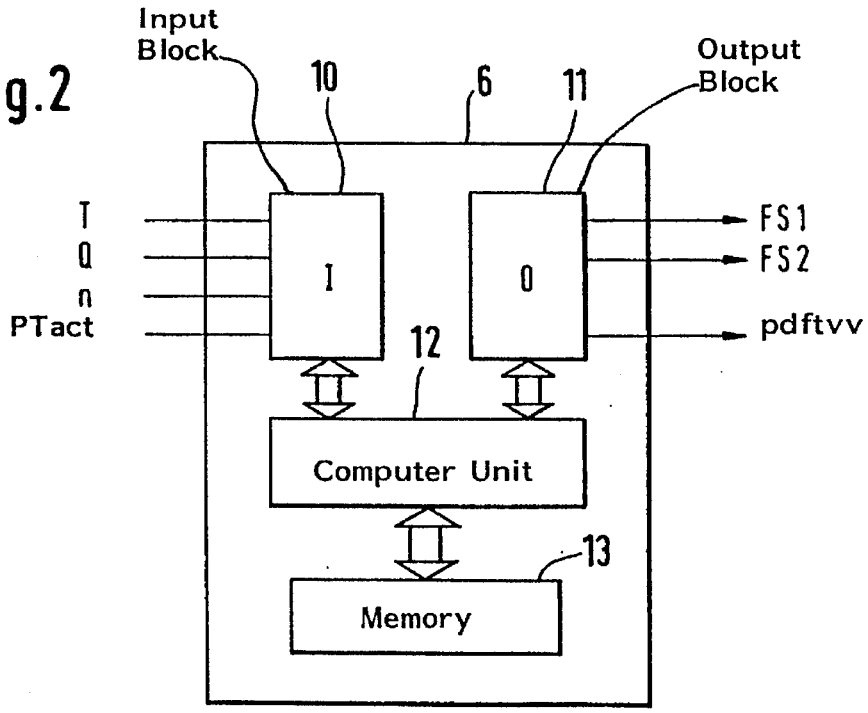

METHOD FOR VENTING A TANK

FIELD OF THE INVENTION

The invention relates to a method for venting fuel tanks in motor vehicles equipped with an internal combustion engine.

BACKGROUND OF THE INVENTION

In known tank-venting systems, fuel vapors develop in the tank and are intermediately stored in an active charcoal filter and are then supplied via a tank-venting valve to the intake pipe of the engine. U.S. Pat. No. 4,318,383 describes a method wherein the tank-venting valve is only then opened when a certain quantity of vaporous fuel is present in the system. The system described in this patent provides that the temperature of the fuel or the overpressure in the tank region is a measure for this quantity. Statutory requirements are provided for monitoring these emission-relevant systems.

U.S. Pat. No. 5,193,512 discloses a tank-venting system which is equipped with a shutoff valve in the venting line of the active charcoal filter. Overpressures as well as underpressures can be adjusted in the tank-venting system with a deliberate opening and closing of this shutoff valve in dependence upon the opening state of the tank-venting valve. These pressure changes are detected by a difference pressure sensor on the tank and the evaluation of these pressure changes makes it possible to provide a statement as to the operability of the tank-venting system. The active charcoal filter is scavenged with fresh air (regeneration) with an opened shutoff valve and a clocked opening of the tank-venting valve. However, the following problem can occur when scavenging the charcoal filter under these conditions. The flow resistance of the active charcoal in the active charcoal filter causes a pressure drop to occur at the active charcoal filter. This pressure drop becomes that much greater the greater the flow resistance of the active charcoal is at a pregiven intake pressure which is determined by the underpressure in the intake pipe, the opening cross section of the tank-venting valve and the conduit geometry. If this resistance increases, for example because of deterioration, then the absolute pressure at the intake end of the active charcoal filter and therefore at the fuel tank drops. This causes, on the one hand, that the tank itself can become damaged and, on the other hand, a low absolute pressure in the tank is unwanted because it causes the fuel to vaporize. It is known to avoid these disadvantages by providing an additional flow resistor and to provide the same, for example, in the form of a flow throttle in the connection of the active charcoal filter to the intake pipe.

SUMMARY OF THE INVENTION

The method of the invention is for controlling a tank-venting system utilized with an internal combustion engine having an intake pipe and a fuel tank connected to the intake pipe via a line system. The method includes the steps of: providing a sensor for supplying a signal as a measure of tile pressure within the fuel tank; predetermining a threshold value for the pressure in the tank which is less than the ambient pressure; and, providing a tank-venting valve in the line system and adjusting the opening state of the tank-venting valve so as to cause the pressure in the tank to remain greater than the threshold value.

Stated otherwise, the method of the invention provides that the scavenging rate, more specifically, the vapor volume flow through the tank-venting valve is so limited that the tank pressure does not drop below a pregiven pressure threshold. This means that the amount of the difference between the ambient pressure and the tank pressure does not increase beyond a pregiven pressure threshold. In this way, the opening of the tank-venting valve is adapted to the flow relationships which change with increasing deterioration of the active charcoal filter. Furthermore, the above-mentioned flow throttle can be omitted. In lieu thereof, the tank-venting valve operates as a controllable flow throttle for avoiding critical underpressures. In this way, the tank is protected against damage and the vaporization of fuel in the tank is reduced.

In an advantageous embodiment, the invention furthermore makes a diagnosis possible with respect to gradually or completely clogged components or a shutoff valve which is closed in a defective manner in that region of the tank-venting system through which scavenging air flows without critically low absolute pressures occurring when the method steps for the diagnosis are carried out. This region of the tank-venting system is located between the ambient air and the active charcoal filter including the charcoal filter itself. These defects can be detected with the invention during the normal regeneration during part-load operation of the engine without special test functions.

BRIEF DESCRIPTION OF THE DRAWINGS

The invention will now be described with reference to the drawings wherein:

FIG. 1 is a schematic of a tank-venting system as it is already known in the state of the art;

FIG. 2 shows the basic function of a control apparatus suitable for carrying out the method of the invention;

DESCRIPTION OF THE PREFERRED EMBODIMENTS OF THE INVENTION

Figure 3:
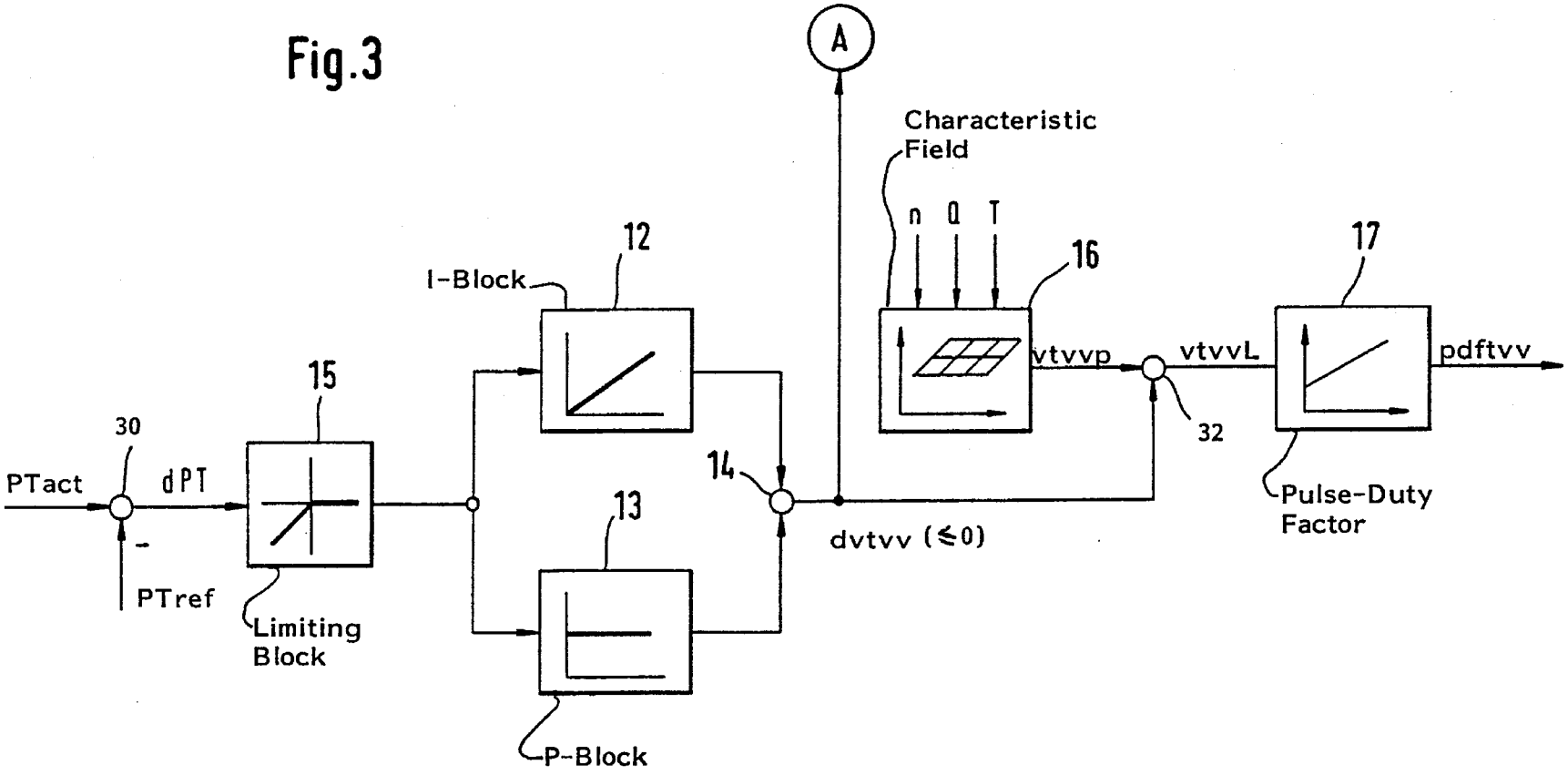
FIG. 3 is a first embodiment of the invention configured as function blocks.

FIG. 1 shows a fuel tank 1, an active charcoal filter 2, a tank-venting valve 3, a shutoff valve 4 in the venting line of the active charcoal filter 2, an air filter 5, a control apparatus 6, an intake pipe 7 of an internal combustion engine, a flow throttle 8 shown separate from its conduit and which is used in accordance with the state of the art and a difference pressure sensor 9 mounted on the tank 1 as well as means *6a* for displaying or storing faults which have been determined. The basic function of a comparable arrangement is explained further above. What is essential here to the invention is that the tank-venting valve 3 is driven by the control apparatus 6 not only in dependence upon operating parameters of the internal combustion engine such as load Q, rpm (n) and temperature T but that also the signal PTact of the difference pressure sensor 9 is so used that the pressure in the tank 1 does not drop below a pregiven minimum value (at least in time average) when the valves 3 and 4 are opened.

FIG. 2 shows the control apparatus 6 of FIG. 1 as a function diagram. The above-mentioned signals T, Q, (n) and PTact are supplied to an input block 10. These signals are further processed in a computer unit 12 with the aid of a program stored in memory 13 and are outputted via the output block 11 as signals pdftvv (pulse-duty factor tank-venting valve) for driving the tank-venting valve and/or as fault signals FS1, FS2 for driving the means 6*a* (FIG. 1) of, for example, a fault lamp.

The function block diagram of FIG. 3 shows a comparator 30, a PI-controller, which includes an I-block 12, a P-block 13 and a summation point 14, a limiting block 15, a characteristic field block 16, a further coupling point 32 as well as a block 17 which emits the pulse-duty factor pdftvv with which the tank-venting valve is driven.

A value vtvvp (volume flow through the tank-venting valve-precontrol) is read out of the block 16 to form this pulse-duty factor. In the coupling point 32, this precontrol value is coupled with a value dvtvv (delta volume flow through the tank-venting valve) which can be less than or equal to zero and which considers the pressure relationships in the tank.

It is assumed, for example, that the absolute pressure in the tank PTact during the regeneration (when valves 3 and 4 are open) is higher than a minimum permissible reference pressure PTref. This case is typical for a good throughflow of the tank-venting system between the venting line to and including the charcoal filter. The difference dPT=PTact−PTref is then positive and the limiting block 15 supplies the input of the controller (12, 13, 14) with 0 as a signal and the output of the controller remains at its value which is likewise 0 when throughflow is good and the value vtvvp read out of the characteristic field 16 for the regeneration vapor flow through the tank-venting valve is not reduced in the coupling point 32.

With increasing clogging of, for example, the active charcoal filter, the pressure PTact drops below a minimum permissible value PTref, the difference dPT becomes negative, the limiting block 15 supplies a negative signal to the controller (12, 13, 14), the controller then supplies a signal dvtw (delta volume flow through the tank-venting valve) which is less than 0. As a consequence, the precontrol value vtvvp is limited in the coupling point 32 to a lower value vtvvL. The last-mentioned value is converted in the block 17 to a pulse-duty factor pdftvv for driving the tank-venting valve.

Stated otherwise, if the actual value PTact drops, for example because of a flow resistance of the charcoal filter increasing with advancing deterioration, to critical lower values, then the pulse-duty factor for driving the tank-venting valve is finally reduced. With the reduction of the pulse-duty factor, the resistance of the tank-venting valve acting as a flow throttle increases.

When venting is working properly, the tank pressure PTact is greater than the reference value PTref and the difference dPT remains correspondingly greater than zero and the precontrol value vtvvp is not limited in this case. Stated otherwise, the flow resistance of the tank-venting valve is not increased in this case.

Figure 4:
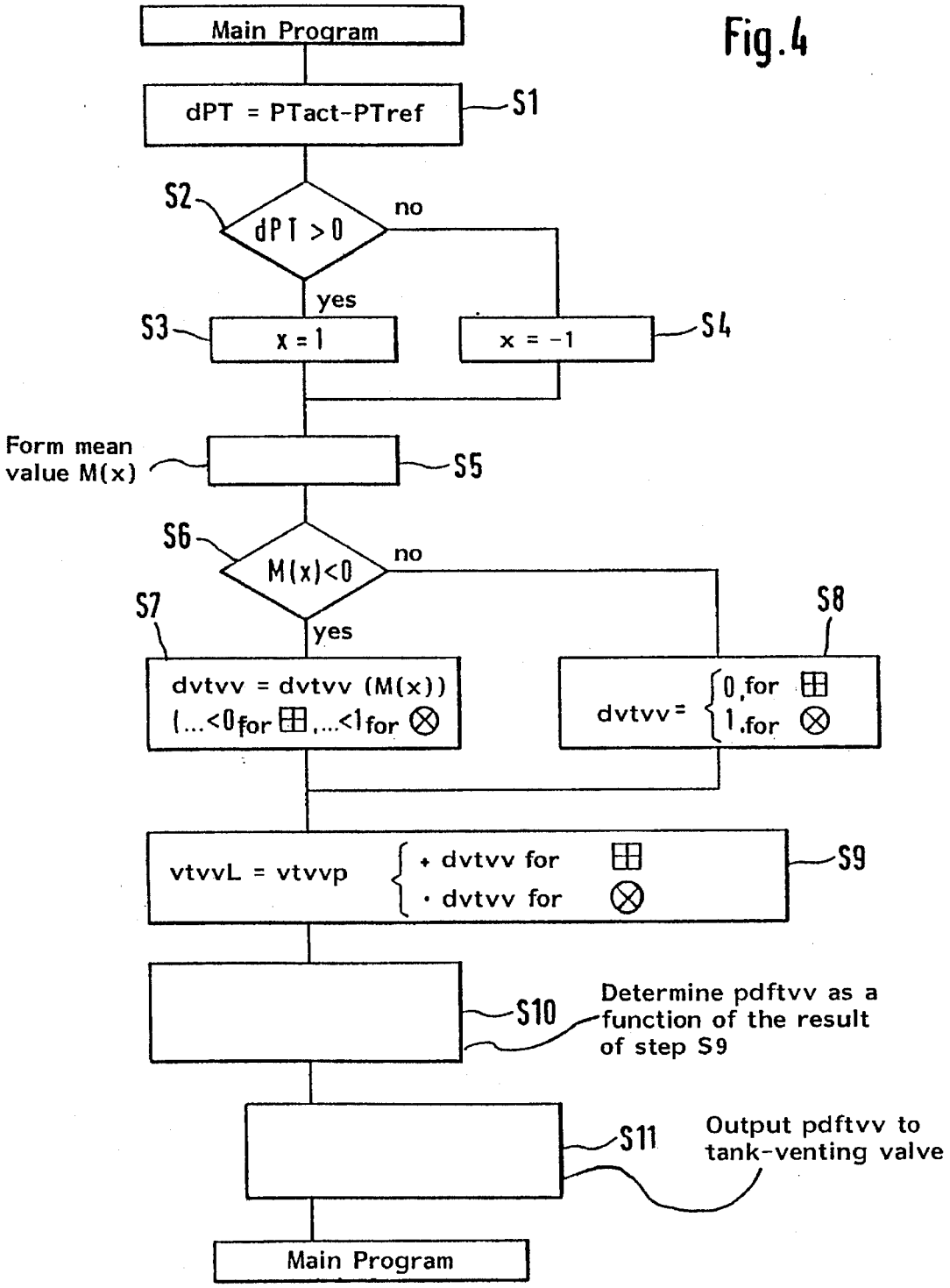
FIG. 4 is a flowchart of a first embodiment of the method of the invention.

FIG. 4 shows a flowchart with which the functional sequence described above can be realized, for example, with the control apparatus of FIG. 2. In step S1, the difference dPT=PTact−PTref is formed. If this difference value is less than zero, then step S2 branches to step S4 and a negative value x=−1 is applied to step S5. In step S5, a mean value M(x) of x-values is formed from several throughruns. M(x) is less than zero when the actual value for the tank pressure PTact lies below its reference value PTref in time average. In this case, and in dependence upon whether the coupling in the next step S9 should take place additively or multiplicatively, the value dvtvv is limited in step S7 to values less than zero or less than 1. If M(x) is greater than 0, then the neutral element of the coupling is emitted in step S8 to step S9. This value is 1 in the case where the coupling takes place multiplicatively and is 0 in the case where the coupling takes place additively. In step S9, a limited value vtvvL is formed as a sum or as a product of the values vtvvp and dvtvv. In step S10, the pulse-duty factor pdftvv for driving the tank-venting valve is determined as a function of the result of step S9 and is outputted to the tank-venting valve in step S11.

Stated otherwise, as soon as the absolute pressure PTact in the tank drops below a minimum permissible value PTref in time average, the pulse-duty factor pdftvv is reduced and the throttle action of the tank-venting valve is thereby increased. The intake power acting on the tank is then finally so reduced that the actual value of the tank pressure does not drop below a minimum permissible reference value (except for fluctuations).

Figure 5:
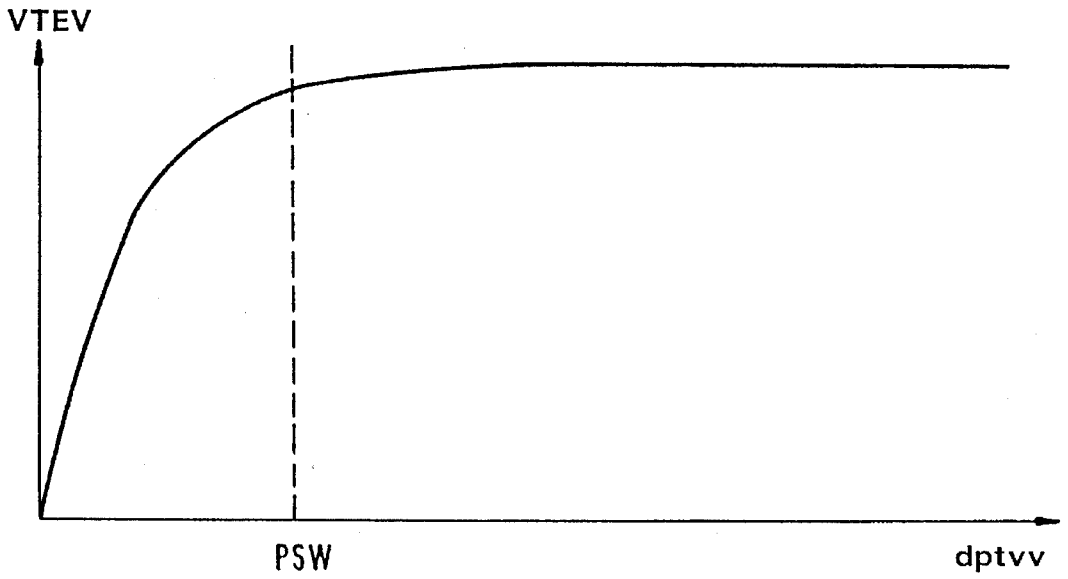
FIG. 5 shows the dependence of the volume flow through the tank-venting valve on the difference pressure at the tank-venting valve.

FIG. 5 shows the volume flow VTEV through the tank-venting valve plotted against the difference pressure dptvv at the tank-venting valve for a fixed pulse-duty factor having an arbitrary scale. It can be seen that the volume flow through the tank-venting valve above a minimum difference pressure PSW becomes relatively independent from the difference pressure at the tank-venting valve. The diagnostic method described with reference to FIG. 6 should be carried out only in the portion of the characteristic line independent of the difference pressure.

Figure 6:
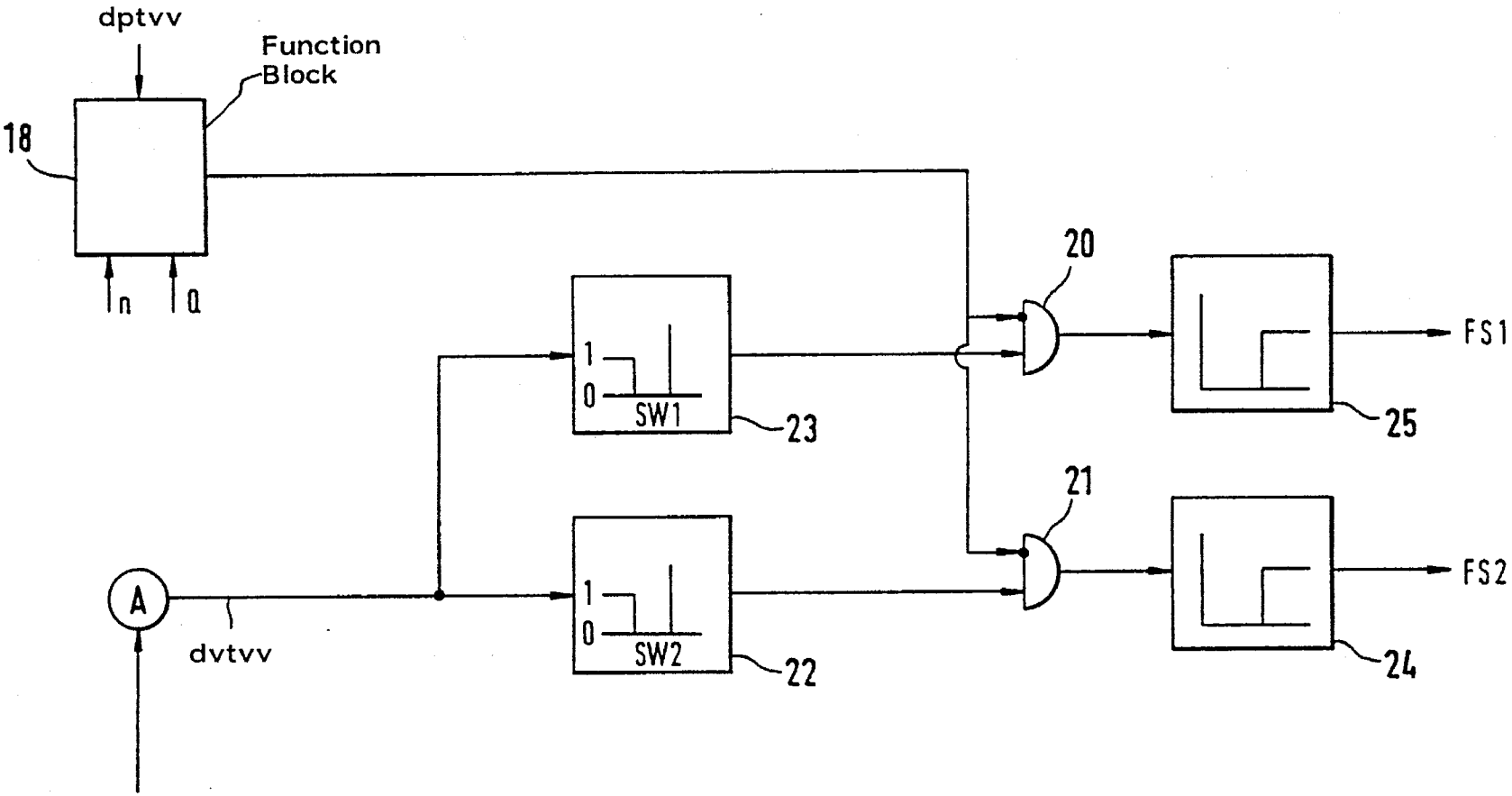
FIG. 6 is a schematic of another embodiment of the invention for carrying out the above-mentioned diagnostic method with the embodiment being shown as a configuration of function blocks; and, FIG. 7 is flowchart of the second embodiment of the method of the invention.

Starting from the mark A in FIG. 6, the signal dvtvv described in FIG. 3 is processed further. In addition to that shown in FIG. 3, the arrangement of FIG. 6 includes a function block 18, AND-components 20 and 21 as well as means 22 to 25 for inquiring as to threshold values. The function block 18 supplies a statement as to along which part of the tank-venting valve characteristic of FIG. 5 processing just then takes place. For this purpose, the difference pressure dptvv at the tank-venting valve is directly measured and compared to a threshold value PSW. A value for this difference pressure can, however, also be simulated from operating parameters of the engine such as load Q and rpm (n). For example, the underpressure in the intake pipe is so low when the throttle flap is fully opened that only slight difference pressures occur at the tank-venting valve. In this case, the function block 18 supplies a 1, otherwise, a 0. If the output is equal to 1, then base conditions, which are represented by the AND-components 20 and 21, are not satisfied and fault signals FS1, FS2 are not given out. Stated otherwise, the diagnostic method is only carried out in the horizontal portion of the characteristic line of FIG. 5.

If this is the case, and the value dvtvv exceeds a predetermined threshold value SW2 (means 22) for a time duration, which exceeds a time threshold ZS2 (means 24), then a fault signal FS2 is outputted which, for example, switches on a fault lamp 6*a* of FIG. 1*a*. The threshold values SW2 and ZS2 can, for example, be so dimensioned that the fault signal FS2 is outputted only after almost a complete blockage of the venting, for example, by a defective shutoff valve 4 or caked active charcoal in the active charcoal filter 2. Furthermore, and under certain circumstances, it is also purposeful to output differentiated fault announcements FS1, FS2. A tank-venting system can be equipped with an air filter 5 in the venting line of the active charcoal filter. A gradual blockage of this air filter can occur in tank-venting systems equipped in this manner. For detecting this state, a threshold value SW1 less than SW2 and a time threshold value ZS1 can be provided. These threshold values can trigger the output of a fault signal FS1 when they are correspondingly exceeded (means 23, 20, 25). This signal can be utilized to display the needed exchange of the air filter at the next service without the need for switching on the fault lamp as in the case FS2.

Figure 7:
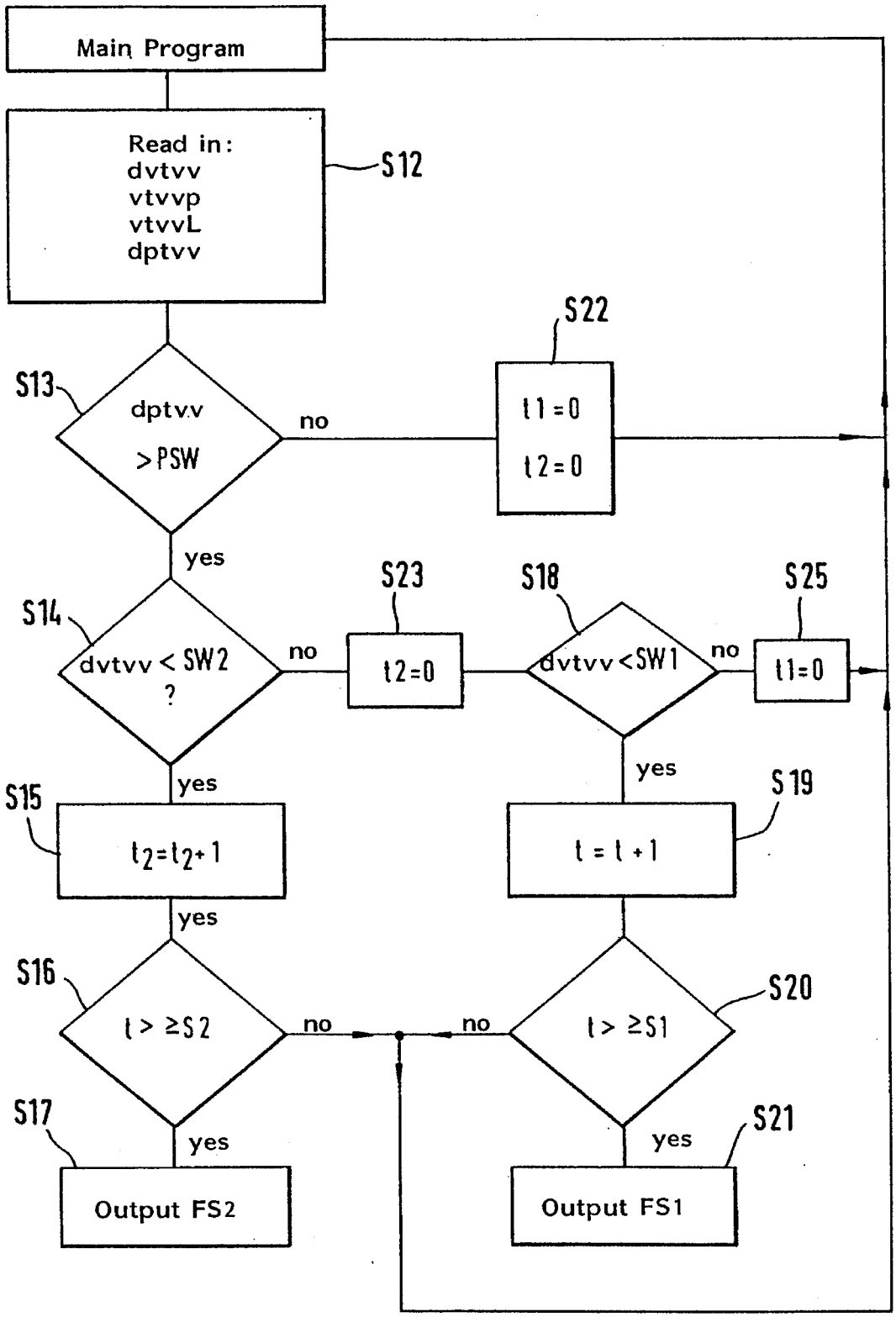

FIG. 7 shows a flowchart for carrying out the diagnostic method by means of a control apparatus of FIG. 2. In step S12, different values are made actual. In step S13, a check is made as to whether the peripheral conditions preferred for diagnosis are satisfied. As mentioned with respect to FIG. 6, the difference pressure dptvv should exceed a pregiven threshold value PSW and the signal dvtvv should be negative. Stated otherwise, the diagnostic method is only carried out in the horizontal portion of the characteristic line of FIG. 5.

The value dvtvv is a measure for the increased flow resistance of the tank-venting system and, if this value drops below a threshold value SW2 in step S14, then a counter position t2 is incremented (step S15). If the counter position exceeds a time threshold value ZS2 in step S16, then a fault signal FS2 is outputted in step S17.

If in contrast, the inquiry in step S14 is negative, then the counter position t2 is initialized anew in step S23, that is, set to t=0. The steps S18 to S21 follow which lead to the output of a fault signal FS1 in a manner similar to steps S14 to S17. The fault signal indicates that the air filter 5 should be exchanged.

This diagnostic routine runs through until a fault signal FS1 or FS2 is outputted insofar as it has not previously been established in step S13 that the diagnostic peripheral conditions are no longer satisfied or the inquiry in step S18 is negative. In both cases, the count variable t2 is initialized anew (S22, S23).

It is understood that the foregoing description is that of the preferred embodiments of the invention and that various changes and modifications may be made thereto without departing from the spirit and scope of the invention as defined in the appended claims.

What is claimed is:

1. A method for controlling a tank-venting system utilized with an internal combustion engine having an intake pipe and a fuel tank which can suffer damage when pressure in the tank becomes signifcantly less than ambient pressure, the fuel tank being connected to the intake pipe via a line system equipped with a tank-venting valve, the method comprising the steps of:

providing a sensor for supplying a signal (PTact) as a measure of the pressure within the fuel tank;

predetermining a threshold value for the pressure in the tank which is less than the ambient pressure; and, adjusting the opening state of the tank-venting valve in dependence upon said pressure in said fuel tank to limit the flow of vapor volume therethrough so as to cause the pressure in the tank to remain greater than said threshold value thereby preventing said damage to said fuel tank.

2. The method of claim 1, wherein said threshold value is predetermined as an absolute pressure value or as a difference to the ambient pressure.

3. A method for controlling a tank-venting system utilized with an internal combustion engine having an intake pipe and a fuel tank connected tot he intake pipe via a line system, the method comprising the steps of:

providing a sensor for supplying a signal (PTact) as a measure of the pressure within the fuel tank;

predetermining a threshold value for the pressure in the tank which is less than the ambient pressure, said threshold value being predetermined as an absolute pressure value or as a difference to the ambient pressure;

providing a tank-venting valve in said line system and adjusting the opening state of the tank-venting valve so as to cause the pressure in the tank to remain greater than said threshold value;

forming a precontrol value in dependence upon operating parameters (n, Q, T) of the engine to define a first value (vtvvp);

generating a second value (dvtvv) from said measure;

coupling said second value with said first value to provide a third value (vtvvL) which is equal to or less than said first value (vtvvp); and, determining the opening state of the tank-venting valve utilizing said third value (vtvvL).

4. The method of claim 3, further comprising the step of forming the mean of said measure for generating said second value (dvtvv).

5. The method of claim 4, wherein said mean value is limited.

6. The method of claim 3, wherein said coupling is performed additively.

7. The method of claim 3, wherein said coupling is performed multiplicatively.

8. A method for diagnosing a tank-venting system utilized with an internal combustion engine having an intake pipe and a fuel tank which can suffer damage when pressure in the fuel tank becomes significantly less than the ambient pressure, the fuel tank being connected to the intake pipe via a line system equipped with a tank-venting valve, the method comprising the steps of:

providing a sensor for supplying a signal (PTact) as a measure of the pressure within the fuel tank;

predetermining two threshold values (SW1 and SW2) for the pressure in the tank which is less than ambient pressure;

forming a value (dvtvv) at least in dependence upon said measure;

comparing said value (dvtvv) with one of said two threshold values (SW1 or SW2) to provide a comparison;

adjusting the opening state of said tank-venting valve in dependence upon said comparison so as to cause the pressure in the tank to remain greater than said one threshold value thereby preventing damage to said fuel tank; and, outputting a fault signal when said one threshold value is exceeded.

9. The method of claim 8, further comprising the step of outputting a fault signal only when said one threshold value (SW1 or SW2) is exceeded for a duration longer than a time threshold value (ZS).

10. The method of claim 8, wherein one of said threshold values is lower than the other one of said threshold values; and, the lower threshold value signals a service station announcement, filter change.

11. The method of claim 10, wherein said other threshold value signals a fault in the system.

12. The method of claim 11, wherein said other threshold value also leads to a switch-on of a fault lamp.

* * * * *

UNITED STATES PATENT AND TRADEMARK OFFICE

CERTIFICATE OF CORRECTION

PATENT NO. : 5,460,142
DATED : October 24, 1995
INVENTOR(S) : Denz et al.

It is certified that error appears in the above-indentified patent and that said Letters Patent is hereby corrected as shown below:

In column 1, line 59: delete "tile" and substitute -- the -- therefor.

In column 3, line 44: delete "dvtw" and substitute -- dvtvv -- therefor.

In column 6, line 7: delete "tot he" and substitute -- to the -- therefor.

Signed and Sealed this

Sixteenth Day of July, 1996

Bruce Lehman

*Attest:*

BRUCE LEHMAN

*Attesting Officer*

*Commissioner of Patents and Trademarks*